US006684914B2

(12) United States Patent
Gershman et al.

(10) Patent No.: US 6,684,914 B2
(45) Date of Patent: Feb. 3, 2004

(54) METHOD AND SYSTEM FOR HIGH-SPEED DISCRETE OBJECT COUNTING AND DISPENSING

(75) Inventors: Vladimir Gershman, Stamford, CT (US); Aleksandr Geltser, Stamford, CT (US)

(73) Assignee: Kirby-Lester, Inc.

( * ) Notice: Subject to any disclaimer, the term of this patent is extended or adjusted under 35 U.S.C. 154(b) by 61 days.

(21) Appl. No.: 09/975,608

(22) Filed: Oct. 11, 2001

(65) Prior Publication Data

US 2003/0070725 A1 Apr. 17, 2003

(51) Int. Cl.[7] ..... B65B 3/04

(52) U.S. Cl. ..... 141/2; 141/18; 141/83; 141/104; 141/105; 53/493; 53/501; 221/7; 221/9; 221/129; 221/133

(58) Field of Search ..... 141/1, 2, 18, 83, 141/94, 100–107, 129, 130, 192, 198; 221/7, 9, 123, 129, 133; 53/52, 493, 495, 501, 168

(56) References Cited

U.S. PATENT DOCUMENTS

| | | | | | |
|---|---|---|---|---|---|
| 3,557,889 | A | | 1/1971 | Rejsa | 177/1 |
| 4,267,894 | A | | 5/1981 | Hirano et al. | 177/25 |
| 4,398,613 | A | | 8/1983 | Hirano | 177/25 |
| 4,577,707 | A | | 3/1986 | Fukuda | 177/25 |
| 4,610,323 | A | | 9/1986 | Chenowth et al. | 177/25 |
| 4,645,019 | A | | 2/1987 | Minamida . | 177/25 |
| 5,348,061 | A | * | 9/1994 | Riley et al. | 141/104 |
| 5,481,855 | A | * | 1/1996 | Yuyama | 53/493 |
| 5,720,154 | A | * | 2/1998 | Lasher et al. | 53/411 |
| 6,161,721 | A | | 12/2000 | Kudera et al. | 221/9 |
| 6,237,804 | B1 | * | 5/2001 | Peery et al. | 221/7 |
| 6,421,584 | B1 | | 7/2002 | Norberg et al. | 700/242 |

* cited by examiner

*Primary Examiner*—Timothy L. Maust
(74) *Attorney, Agent, or Firm*—Gordon & Jacobson, P.C.

(57) ABSTRACT

A discrete object dispensing system and method dispenses any selected number of objects, up to a maximum number, without a delay associated with counting the tablets. A preset number of objects are counted and stored in dedicated chambers, the combination of the numbers of objects within the chambers being known to comprise any number of objects which is desired for dispensing. According to a preferred system, n chambers are provided, with $2^0$, $2^1$, $2^2$, . . . , $2^{n-1}$ tablets provided respectively in the individual chambers. The chambers which together add up to the selected number for dispensing are emptied. Only those chambers which are emptied after dispensing need to be refilled and, as such, only the number of tablets in those storage locations need to be counted. The system may include a plurality of cells, each including a plurality of chambers for a different solid dose medication.

20 Claims, 6 Drawing Sheets

METHOD AND SYSTEM FOR HIGH-SPEED DISCRETE OBJECT COUNTING AND DISPENSING

BACKGROUND OF THE INVENTION

1. Field of the Invention

This invention relates broadly to counting and dispensing apparatus. More particularly, this invention relates to feeding and counting apparatus which are adapted to dispense any selected number of discrete objects, up to a maximum number, without a delay associated with counting the objects.

2. State of the Art

In retail, hospital, and mail order medication dispensing, a large number of different prescriptions of single dose medications, such as tablets, must be filled. (Hereinafter, reference to "tablets" should be understood for purposes herein as being generic to tablets, capsules, caplets and any other solid dose medication).

Larger quantity prescriptions are often filled with the aid of a counting apparatus intended to more rapidly count different quantities of different tablets successively. For example, a prescription for ninety tablets of 10 mg Claritin® may need to be filled after a prescription for sixty tablets of 400 mg Motrin®.

With an automatic tablet counter, the pharmacist obtains a bulk container of a prescription medication from a shelf and then pours from the container a quantity of tablets into a hopper of the counting apparatus. The pharmacist then sets the counting apparatus to the number of tablets to be counted, e.g., ninety. Assuming at least the required number of tablets for the prescription has been poured into the hopper, the pharmacist waits while the counting apparatus counts the required number of tablets and dispenses the tablets into a patient prescription bottle. The excess tablets are discharged back into the bulk container, which is then replaced on the shelf. It has been found that the time taken to discharge the excess tablets can be equal to or greater than the time required to count the prescription.

Each prescription medication must be obtained from a bulk storage container located in stock, which must be opened prior to use and closed after use. In order to minimize the time taken to dispense a prescription, counter manufacturers have provided "cassette counters" for retail, hospital, and mail order pharmacies. Each cassette is designed for a specific size and shape capsule, tablet, or caplet. The cassettes are pre-filled by the pharmacist with bulk quantities of the appropriate prescription drugs, and are used to store bulk quantities rather than using the container supplied by the manufacturer. The prescription medication is then dispensed directly from the cassette. The use of cassettes eliminates the time needed to open the manufacturer's original container, the time needed to return excess tablets to the container, and the time needed to close the container.

However, there are situations, particularly in bulk mail order pharmacies and high volume hospital dispensing, where greater dispensing speed is desired than is currently provided by automatic dispensing systems, particularly for the most frequently dispensed medications.

SUMMARY OF THE INVENTION

It is therefore an object of the invention to provide a system for dispensing a selected quantity of tablets extremely rapidly, irrespective of the type of tablet and the quantity of tablets dispensed.

It is another object of the invention to provide a system for dispensing tablets which incorporates a plurality of storage areas for different tablets within the system.

It is a further object of the invention to provide a system for dispensing tablets which functions with all tablets regardless of size, shape, and weight.

It is an additional object of the invention to provide a system for dispensing tablets which is not prone to clogging.

In accord with these objects, which will be discussed in detail below, a system and method for storing and dispensing discrete objects, such as 'tablets' (stated above to be generic for tablets, capsules, caplets and any other solid dose medication), is provided and adapted to dispense any selected number of tablets, up to a maximum number, without a delay associated with counting the tablets.

The system and methodology include first counting and storing a preset number of tablets in respective dedicated chambers (storage locations), the combination of the numbers of tablets within the chambers being known to comprise any number of tablets which is desired for dispensing. According to a preferred system and method, n chambers are provided, with $2^0$, $2^1$, $2^2$, . . . , $2^{n-1}$ tablets provided respectively in the individual chambers. Using such a system, any number of tablets, up to the additive combination of all the chambers (e.g., where n=7, the additive combination is 127), can be dispensed by selectively emptying the chambers which together add up to the selected number for dispensing. Because the number of tablets in each of the chambers is always the same, the system optionally can be hardwired to select the tablets from the required chambers without any combinatorial computation process; i.e., for any number of tablets selected for dispensing, there always exists a particular readily determinable combination of chambers which can be emptied to comprise the selected number of tablets exactly. Alternatively, the chambers can be selected by a simple computational process; i.e., first identifying the chamber having the largest number of tablets less than the selected number for dispensing, then identifying the chamber having the next largest number of tablets, provided that the addition of such number of tablets to the previously identified chamber does not exceed the selected number for dispensing, then identifying the chamber having the next largest number of tablets, provided that the addition of such number of tablets to the previously identified chambers does not exceed the selected number for dispensing, etc., until the desired number of tablets has been identified. As each chamber is identified, or after all have been identified, the exit gates are released, preferably in succession, to dispense the tablets.

After the selected chambers are emptied, the opened exit gates are closed, and only the emptied chambers are filled with the number of tablets required for the respective chambers. The tablets are fed from a feeder which stores bulk quantities of the tablet, counted, and directed into the emptied chambers to refill the chambers with the preset number of tables. The direction of the tablets into the emptied chambers for filling is preferably controlled by refill gates which open to receive the required number of tablets and close once appropriately refilled. It is appreciated that only those chambers which are emptied after dispensing need to be refilled and, as such, only the number of tablets in those storage locations need to be counted.

The system may include a plurality of cells, each including a plurality of chambers for a different solid dose medication. The solid dose medication may then be selected along with the number of tablets required to be dispensed.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
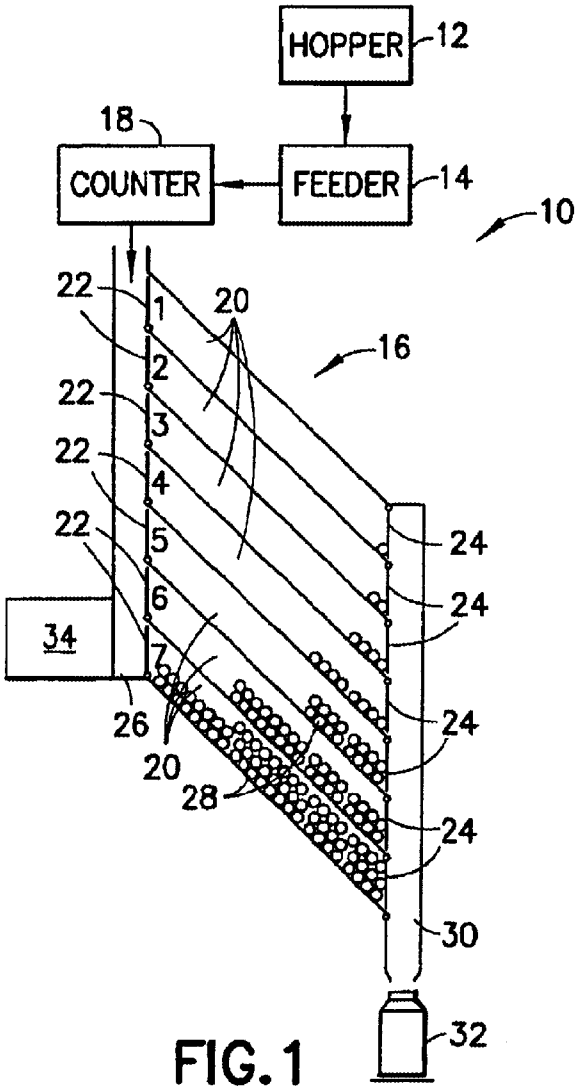
FIG. 1 is a schematic view of an object counting and dispensing system according to the invention including a cell provided with chambers having tablets.

Turning now to FIG. 1, a tablet dispensing system 10 is shown which includes a hopper 12 which stores a bulk quantity of tablets, a feeder 14 which feeds tablets from the hopper 12 to a cell 16, which is described in more detail below, a counter 18 which counts the tablets fed by the feeder to the cell 16, and a controller 34 which operates the cell 16 and permits a user to enter or select the number of tablets to be dispensed.

The hopper 12, feeder 14 and counter 18 may be of any type known in the art suitable for counting small discrete objects, such as tablets. For example, the hopper 12 and feeder 14 may be a vibratory bowl feeder, a mechanical feeder, or a cassette system such as described in co-pending U.S. Ser. No. 09/871,531, filed May 31, 2001, which is hereby incorporated by reference herein in its entirety, each of which may have an integrated unit which functions as both a hopper and a feeder. The counter 18 is preferably an optical system which uses an optical sensor array, such as that disclosed in co-owned U.S. Pat. No. 5,768,327, which is hereby incorporated by reference herein in its entirety. The optical sensor array of U.S. Pat. No. 5,768,327 includes an orthogonal arrangement of two discrete optical sensors which together sense objects in three dimensions. This sensor arrangement is adapted to sense multiple objects simultaneously falling past the sensors.

The cell 16 includes a plurality of vertically-stacked inclined chambers (storage locations) 20 positioned below the counter 18. Seven chambers sequentially numbered one through seven are shown in the embodiment of FIG. 1. The chambers 20 each have a fill gate 22 and an exit gate 24. When the fill gate 22 of any chamber is open, that chamber is in communication with a feed chute 26 and thereby adapted to receive tablets 28 fed from the feeder 14 and counted by the counter 18. With the respective exit gates 24 closed, each chamber 20 stores a predetermined, and preferably different, number of tablets. As discussed in more detail below, when the exit gate 24 of any chamber is in an open position, the tablets stored within the chamber 20 are released into an exit chute 30, and from the exit chute 30 the tablets are dispensed into a container 32. The fill gates and exit gates are preferably electromechanically controlled, e.g., with solenoids powered by the controller 34, to effect movement of the gates between open and closed positions.

The combination of the numbers of tablets within the plurality of chambers 20 is capable of comprising any number of tablets which is desired for dispensing. According to a preferred system, n chambers are provided, with $2^0$, $2^1$, $2^2$, . . . , $2^{n-1}$ tablets provided respectively in the individual chambers 20. Using such a system, any number of tablets, up to the additive combination of all the chambers (e.g., where n=8, the additive combination is 255), can be dispensed by selectively emptying the chambers which together add up to the selected number for dispensing.

As shown in FIG. 1, in an embodiment of the invention, seven chambers 20 are provided; i.e., n=7. The chambers are provided with tablets as follows: chamber one includes one tablet ($2^0$); chamber two includes two tablets ($2^1$); chamber three includes four tablets ($2^2$); chamber four includes eight tablets ($2^3$); chamber five includes sixteen tablets ($2^4$); chamber six includes thirty-two tablets ($2^5$); and chamber seven includes sixty-four tablets ($2^6$).

Figure 2:
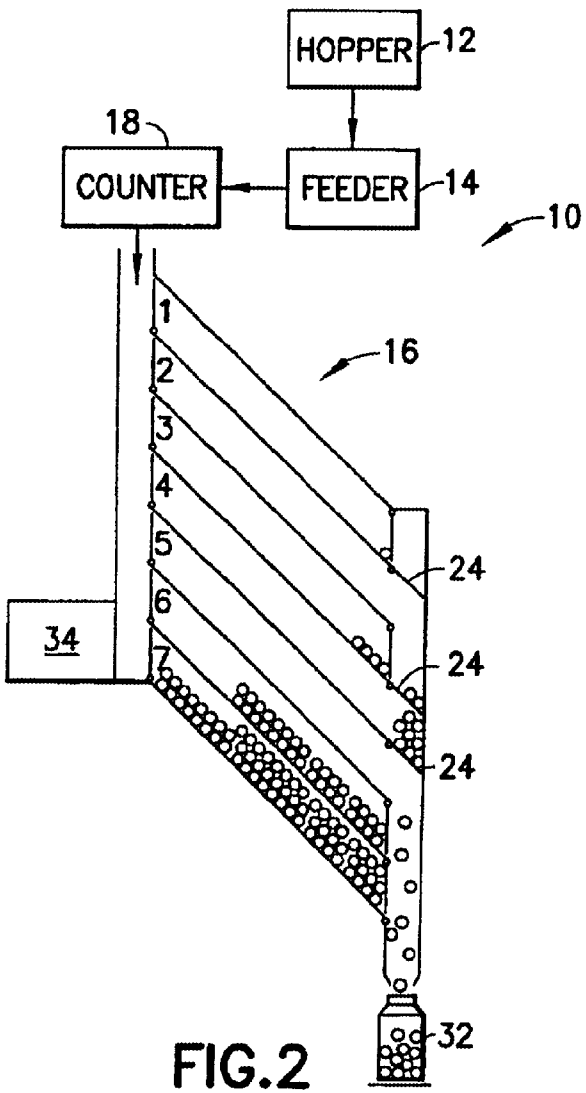
FIGS. 2, 3 and 4 are schematic views of the object counting and dispensing system of FIG. 1, showing a sequence for release and closure of exit gates.
Figure 4:
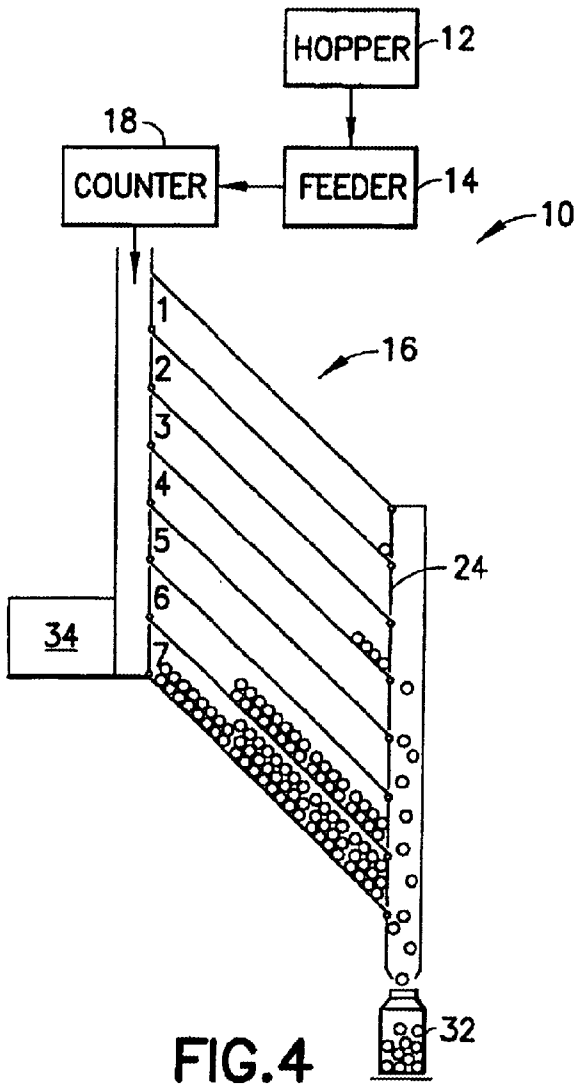
Figure 3:
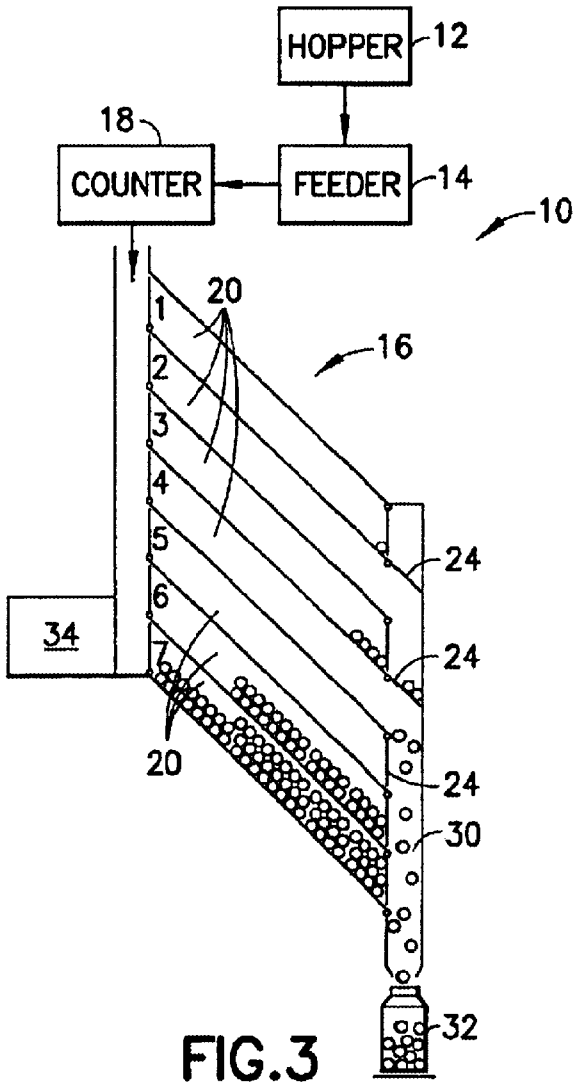

Referring to FIG. 2, if it is desired to dispense, e.g., twenty-six tablets, twenty-six tablets are selected at the controller 34 which causes the exit gates 24 of chambers two, four and five to be opened. The gates may be opened simultaneously. However, in the embodiment of the invention as shown, where the gates swing open, the gates are preferably opened in succession and at time intervals, e.g., 0.25 seconds between each opening, starting with the gate of the lowermost chamber. The time interval prevents jamming by the tablets. As the exit gates are opened, the tablets in the respective chambers (two, eight, and sixteen tablets, respectively) are released into the exit chute 30. The sixteen tablets from chamber five fall directly into the container, while the tablets from chambers four and two are retained the open exit gates of chambers five and four respectively. Referring to FIG. 3, the exit gates 24 are then closed from the bottom up, preferably again in succession and at a short time interval, to releas the retained tablets into the chute 30 for dispensing. That is, when the exit gate 24 of chamber five is closed, the tablets from chamber four which were resting on that gate are released to fall through the exit chute and into the container. Likewise, when the exit gate 24 of chamber four is closed, the two tablets retainer from chamber two fall into the container 32. Referring to FIG. 4, the exit gate 24 of chamber two, previously holding the two tablets is then closed.

As is discussed hereinafter, because the number of tablets in each of the particular chambers 20 is kept constant (due to refilling), the system optionally can be hardwired at the controller 34 to open the exit gates from the required chambers without any combinatorial computation process; i.e., for any number of tablets selected for dispensing, there always exists a particular readily determinable combination of chambers which can be emptied to comprise the selected number of tablets exactly, up to the maximum number of tablets stored in the cell 16.

Alternatively, the chambers can be selected by a simple computational process performed by the controller 34, for example, by first identifying the chamber having the largest number of tablets less than the selected number for dispensing, then identifying the chamber having the next largest number of tablets, provided that the addition of such number of tablets to the previously identified chamber does not exceed the selected number for dispensing, then identifying the chamber having the next largest number of tablets, provided that the addition of such number of tablets to the previously identified chambers does not exceed the selected number for dispensing, etc., until the desired number of tablets has been identified. As each chamber is identified, or after all have been identified, the exit gates are opened and closed, preferably in succession as described above, to dispense the tablets.

The tablet dispensing system requires no tablet counting time because the chambers of the cell are preloaded. The only time required is for the gates to open to release and empty the tablets from the identified chambers. While time is required to refill the emptied chambers, the refill occurs after dispensing and presumably while the system operator is completing the prescription requirement (e.g., labelling, data entry, packaging, etc.) or identifying and/or preparing the subsequent prescription information; i.e., refill occurs during system operator downtime.

Figure 6:
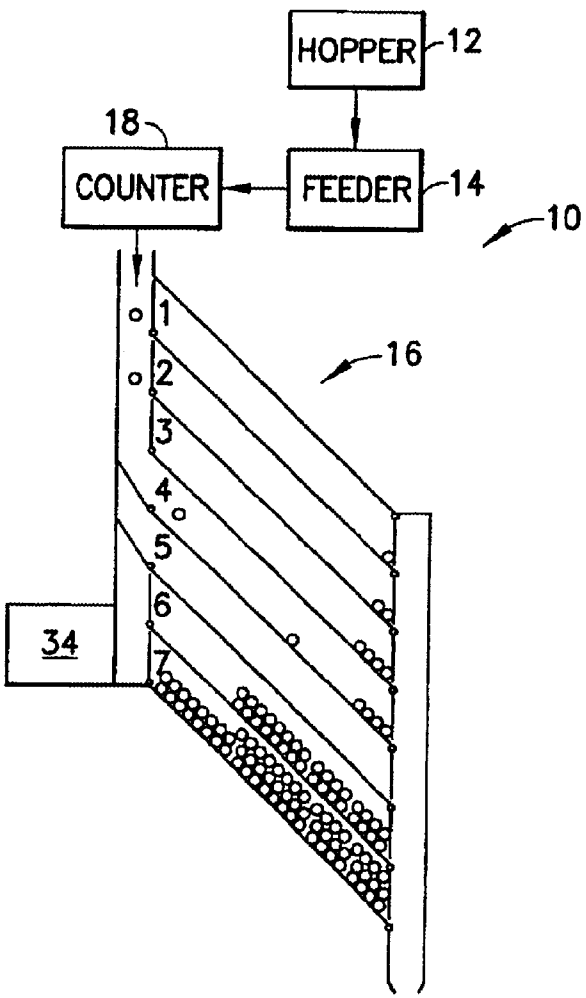
FIGS. 5, 6 and 7 are schematic views of the object counting and dispensing system of FIG. 1, showing a sequence for opening and closure of refill gates.
Figure 5:
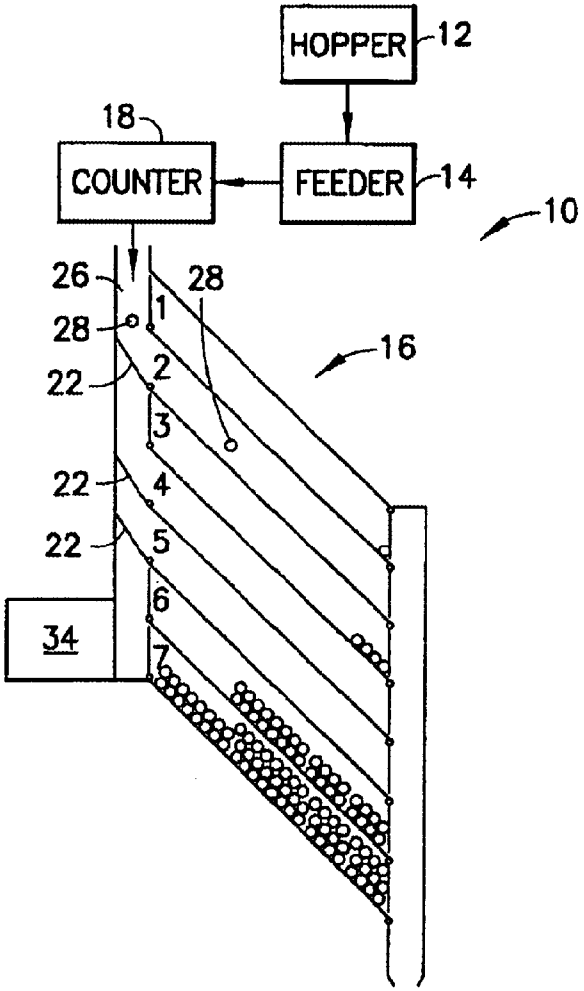
Figure 7:
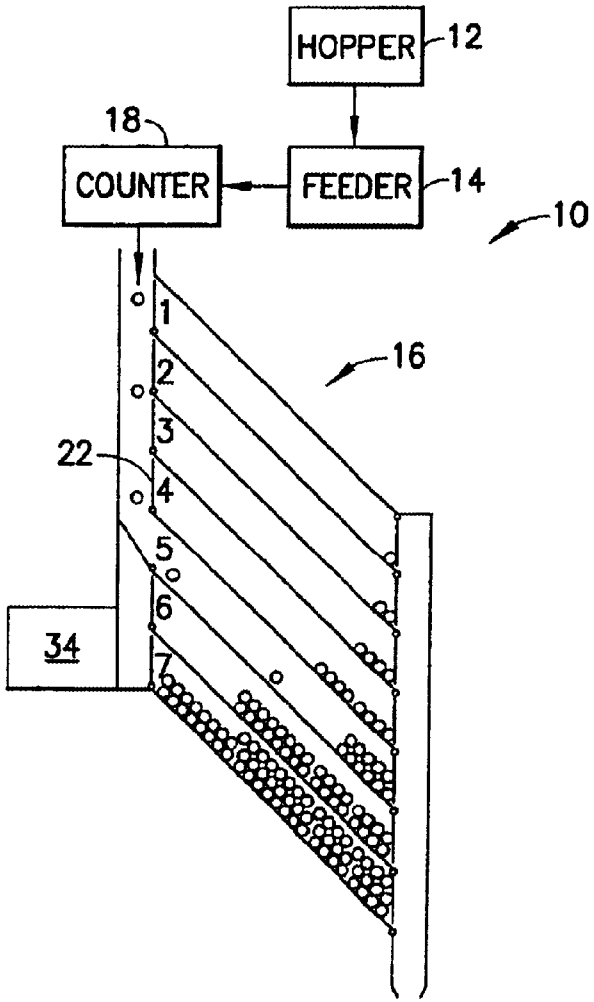

After the identified chambers have been emptied, such chambers need to be refilled for subsequent dispensing operations. Referring now to FIG. 5, the fill gates 22 of the emptied chambers (chambers two, four, and five in the example) are opened, and the tablets 28 are fed by the feeder 14 from the hopper 12 to the counter 18 (which is preferably an optical counter such as disclosed in co-owned U.S. Pat. No. 5,768,327). Once the counter counts the required number of tablets for the uppermost emptied chamber (chamber two), and after a short predetermined delay to permit the tablets to fall through the fill chute 26 to the respective chamber, the fill gate of that chamber is closed, as shown in FIG. 6. Still referring to FIG. 6, then the tablets required for the next chamber (i.e., chamber four) are counted, enter the fill chute and fall through the open fill gate to the chamber. Referring to FIG. 7, once chamber four is refilled, its respective fill gate 22 is closed, and chamber five is refilled in a like manner. It is appreciated that only those chambers which are emptied after dispensing need to be refilled and, as such, only the number of tablets in those chambers need to be counted. It is also appreciated that the dispensing system is initialized by counting and directing the required number of tablets to each of the respective chambers.

Figure 8:
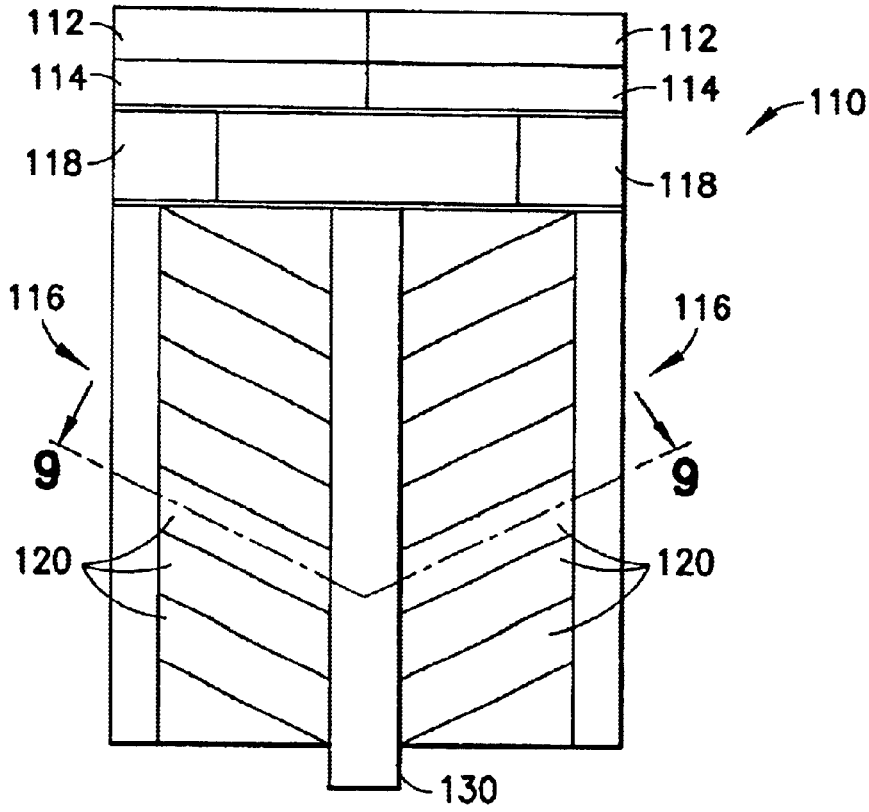
FIG. 8 is a schematic section of a side elevation view of a first embodiment of a multi-cell object counting and dispensing system.
Figure 9:
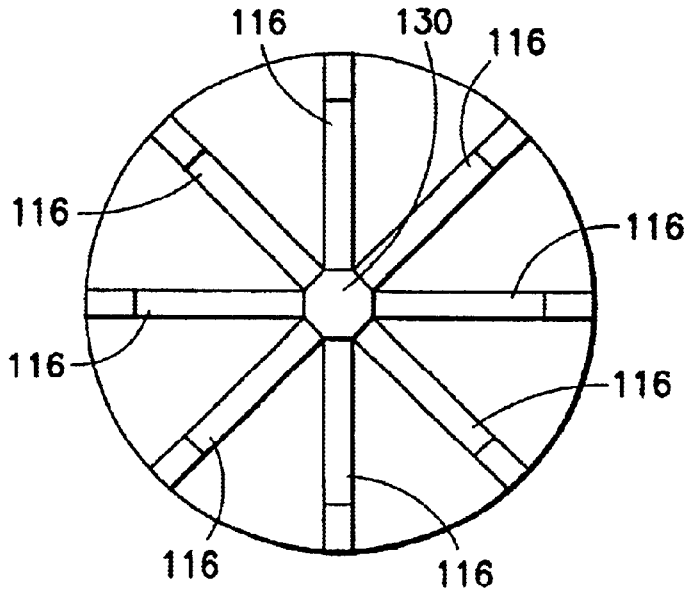
FIG. 9 is a schematic section view through line 9—9 in FIG. 8.

Referring to FIGS. 8 and 9, a tablet dispensing system 110 may include a plurality of radially arranged cells 116 each including a plurality of chambers 120 for a different solid dose medication. Each of the cells 116 is preferably provided with its own hopper 112, feeder 114 and counter 118. The solid dose medication may be selected from a controller (not shown) along with the number of tablets required to be dispensed. A common exit chute 130 can be used for dispensing into a bottle or container.

Figure 10:
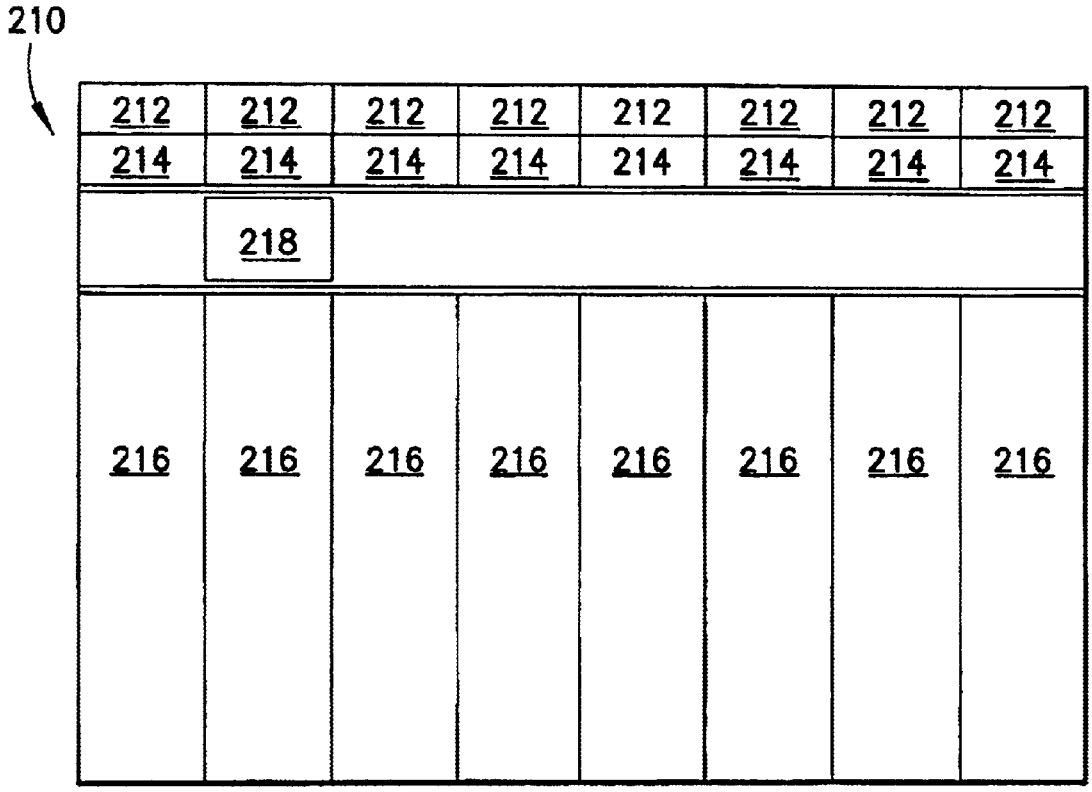
FIG. 10 is a schematic view of a second embodiment of a multi-cell object counting and dispensing system.

Turning now to FIG. 10, another embodiment of a multi-cell tablet dispensing system 210 is shown. Each cell 216 includes its own hopper 212 and preferably a feeder 214. A common counter 218 may be movable between the hoppers 212, feeders 214, and the cells 216. Alternatively, the feeder 214 may be integrated with the counter 218 and also movable relative to the hoppers 212 and cells 216. From the above multi-cell system embodiments, is understood that various other configurations of a multi-cell system may be implemented.

While the preferred system includes cells with n chambers provided with $2^0, 2^1, 2^2, \ldots, 2^{n-1}$ tablets in the respective chambers, it will be appreciated that chambers having another arrangement of tablet quantities may be used, provided that such arrangement permits the desired number of tablets to be dispensed. It is appreciated that not every number of tablet need be able to be dispensed, just those quantities which are generally prescribed.

There have been described and illustrated herein several embodiments of a tablet dispensing system and a method of dispensing tablets. While particular embodiments of the invention have been described, it is not intended that the invention be limited thereto, as it is intended that the invention be as broad in scope as the art will allow and that the specification be read likewise. Thus, while the gates may be operated with a solenoid, it is appreciated that other means for moving the gates may be used. Also, while swinging gates have been disclosed, it will be appreciated that other types of gates can be utilized. In fact, if vertical space is provided between chambers, vertically moving gates may be utilized, and when vertically moving gates are utilized, all gates may be opened simultaneously, and all tablets may be dispensed immediately. In addition, while a particular number of chambers have been shown in each cell, it will be understood that other numbers of chambers may be used. Moreover, while the number of tablets in each of the chambers is shown to increase with the successively lower located chambers, it is understood that the number of tablets designated for the chambers can be otherwise organized, e.g., a decreasing number of tablets as the chambers are located lower, or with another order to the number of tablets in relation to the location of the chambers. In addition, while a controller is shown, it is appreciated that the controller may comprise two or more discrete systems; e.g., a system which permits user input, a system which controls gate operation, a system which controls the feeder, and a system which communicates with the object counter to turn off the feeder once the required number of tablets have been counted. Also, while the system is described with respect to dispensing tablets, it will be appreciated that the system and method apply to the dispensing of other relatively small discrete objects. It will therefore be appreciated by those skilled in the art that yet other modifications could be made to the provided invention without deviating from its spirit and scope as claimed.

What is claimed is:

1. A discrete object dispensing system for dispensing discrete objects, comprising:

a) a plurality of chambers, each including a discrete and predetermined number of objects;

b) means for inputting a number of said objects to be dispensed; and c) means for releasing the predetermined number of discrete objects from a subset of at least two of said plurality of chambers for supply to a container, the addition of the predetermined number of objects from said subset of said plurality of chambers equalling said number of objects to be dispensed.

2. A discrete object dispensing system according to claim 1, wherein:

n chambers are provided, with $2^0, 2^1, 2^2, \ldots, 2^{n-1}$ objects provided respectively in said n chambers.

3. A discrete object dispensing system according to claim 1, wherein:

said chambers are vertically stacked.

4. A discrete object dispensing system according to claim 1, further comprising:

d) a fill chute with which each of said plurality of chambers can be in communication to receive objects into said plurality of chambers; and e) an exit chute with which each of said plurality of chambers can be in communication to empty the objects from the subset of chambers.

5. A discrete object dispensing system according to claim 1, further comprising:

d) a hopper which stores bulk quantities of the objects;

e) a feeder which feeds objects from said hopper to said plurality of chambers; and f) a counter which counts the objects fed by the feeder.

6. A discrete object dispensing system according to claim 5, wherein:

each said chamber is provided with a fill gate which can be selectively opened to receive objects fed by the feeder.

7. A discrete object dispensing system according to claim 1, wherein:

said means for releasing includes exit gates which can be selectively opened to release objects from said subset of chambers and a controller which determines which exit gates to open to release and dispense the number of objects to be dispensed.

8. A discrete object dispensing system for dispensing discrete objects, comprising:

a) n chambers, where n is greater than five, with $2^0, 2^1, 2^2, \ldots, 2^{n-1}$ objects provided respectively in said n chambers;

b) means for selecting a number of said objects to be dispensed from said n chambers; and c) control means for determining a combination of said n chambers from which the objects therein add up to the selected number of objects to be dispensed.

9. A discrete object dispensing system according to claim 8, wherein:

said n chambers are vertically stacked.

10. A discrete object dispensing system according to claim 8, wherein:

said n chambers are each at an incline.

11. A discrete object dispensing system according to claim 8, wherein:

each of said n chambers includes a fill gate and an exit gate and said discrete object dispensing system includes means for opening and closing said fill and exit gates of said n chambers.

12. A discrete object dispensing system according to claim 8, further comprising:

d) a hopper which stores bulk quantities of the objects;

e) a feeder which feeds objects from said hopper to said n chambers; and f) a counter which counts the objects fed by the feeder.

13. A discrete object dispensing system according to claim 8, wherein:

said control means is hardwired to automatically select a predetermined combination of said n chambers to dispense a selected number of said objects.

14. A discrete object dispensing system according to claim 8, wherein:

said control means is adapted to perform a computational process to determine a combination of said n chambers necessary to dispense a selected number of said objects.

15. A discrete object dispensing system, comprising:

a) a plurality of cells including, i) a plurality of chambers provided with a discrete and predetermined number of objects, ii) a bulk object storage location, and iii) means for feeding said objects from said bulk storage location to said plurality of chambers, wherein said bulk object storage location of each of said cells stores a different type of object;

b) means for inputting a type and number of said objects to be dispensed; and c) means for releasing the predetermined number of discrete objects of the input type from a subset of at least two of said plurality of chambers of a respective cell from supply to a container, the addition of the predetermined number of objects from said subset of said plurality of chambers from said respective cell equalling said number of objects to be dispensed.

16. An object dispensing system, comprising:

a) a plurality of chambers each having a fill gate at an upper portion of said chamber and an exit gate at a lower end of said chamber, said fill and exit gates movable between open and closed positions;

b) a fill chute in communication with any of said plurality of chambers having a fill gate in an open position;

c) an exit chute in communication with any of said plurality of chambers having an exit gate in an open position;

d) gate control means for individually opening and closing said fill and exit gates of said plurality of chambers;

e) a bulk storage means for storing bulk quantities of discrete objects;

f) a feeder means for feeding discrete objects from said bulk storage means to said fill chute;

g) a counter means for counting discrete objects fed by the feeder;

h) means for inputting a number of said objects to be dispensed; and i) dispensing control means for controlling said gate control means to release a predetermined number of discrete objects from a subset of at least two of said plurality of chambers for supply to a container, wherein the addition of the predetermined number of objects from said subset of said plurality of chambers equalling said number of objects to be dispensed.

17. An object dispensing system according to claim 16, wherein:

said chambers are inclined.

18. An object dispensing system according to claim 17, wherein:

said chambers are vertically stacked.

19. A method of dispensing objects, comprising:

a) providing a plurality of chambers, each including a discrete and predetermined number of objects;

b) inputting a number of said objects to be dispensed;

c) selecting a subset of at least two of said plurality of chambers which together contain the input number;

d) emptying the predetermined number of discrete objects from the subset of at least two of said plurality of chambers;

e) dispensing the released objects into a container; and f) refilling the emptied subset of said plurality of chambers.

20. A discrete object dispensing system for dispensing descrete objects, comprising:

a) a plurality of chambers, each including a discrete and predetermined number of objects;

b) means for inputting a number of said to be dispensed; and c) means for releasing the predetermined number of discrete objects from a subset of said plurality of chambers, the addition of the predetermined number of objects from sdaid subset of said plurality of chambers equalling said number of objects to be dispensed;

d) a fill chute with which each of said plurality of chambers can be in communication to receive objects into said plurality of chambers; and e) an exit chute with which each of said plurality of chambers can be in communication to empty the objects from the subset of chambers.

* * * * *